US007469040B2

(12) United States Patent
Holm et al.

(10) Patent No.: US 7,469,040 B2
(45) Date of Patent: Dec. 23, 2008

(54) X-RAY TUBE FOR HIGH DOSE RATES, METHOD OF GENERATING HIGH DOSE RATES WITH X-RAY TUBES AND A METHOD OF PRODUCING CORRESPONDING X-RAY DEVICES

(75) Inventors: Kurt Holm, Baden/Schweiz (DE); Mark Joachim Mildner, Rizenbach/Schweiz (DE); Lars-Ola Nilsson, Schweiz (CH); Adrian Riedo, Schweiz (CH); Toni Waber, Schweiz (CH)

(73) Assignee: Comet Holding AG, Flamatt (CH)

( * ) Notice: Subject to any disclaimer, the term of this patent is extended or adjusted under 35 U.S.C. 154(b) by 182 days.

(21) Appl. No.: 10/591,412

(22) PCT Filed: Mar. 2, 2004

(86) PCT No.: PCT/EP2004/050236

§ 371 (c)(1),
(2), (4) Date: Sep. 1, 2006

(87) PCT Pub. No.: WO2005/086203

PCT Pub. Date: Sep. 15, 2005

(65) Prior Publication Data

US 2008/0049902 A1 Feb. 28, 2008

(51) Int. Cl.
*H01J 35/06* (2006.01)

(52) U.S. Cl. ..... 378/136; 378/143

(58) Field of Classification Search ..... 378/136, 378/119, 121, 122, 129, 134, 138, 143
See application file for complete search history.

(56) References Cited

U.S. PATENT DOCUMENTS

| | | | | |
|---|---|---|---|---|
| 4,670,894 | A | 6/1987 | Birnbach et al. | |
| 5,729,583 | A | 3/1998 | Tang et al. | |
| 6,385,292 | B1 * | 5/2002 | Dunham et al. | 378/122 |
| 6,477,233 | B1 * | 11/2002 | Ribbing et al. | 378/136 |
| 2001/0019601 | A1 | 9/2001 | Tkahashi et al. | |
| 2002/0021068 | A1 | 2/2002 | Espinosa | |
| 2003/0002627 | A1 | 1/2003 | Espinosa et al. | |
| 2003/0063707 | A1 | 4/2003 | Mulhollan | |
| 2004/0008818 | A1 | 1/2004 | Rangsten et al. | |

FOREIGN PATENT DOCUMENTS

| | | | |
|---|---|---|---|
| DE | 198 32 032 | C1 | 2/2000 |
| FR | 2 574 592 | A | 6/1986 |
| WO | WO 99 62589 | A | 12/1999 |

* cited by examiner

*Primary Examiner*—Courtney Thomas
(74) *Attorney, Agent, or Firm*—Reising, Ethington, Barnes, Kisselle, P.C.

(57) ABSTRACT

X-ray tube (11/12) for high dose rates, a corresponding method for generating high dose rates with X-ray tubes (11/12) as well as a method for producing corresponding X-ray devices (11/12), in which an anode (31/32) and a cathode (21/22) are disposed opposite each other in a vacuumized internal chamber (41/42), electrons e– being accelerated to the anode (31/32) by means of impressible high voltage. The anode (31/32) is made of a layer or coating of a metal having a high atomic number, for conversion of the electrons ($e^-$) into X-ray radiation (γ) with cooling. The cathode (21/22) comprises a substrate substantially transparent for X-ray radiation (γ). In particular, the likewise substantially transparent for X-ray radiation (γ). In particular, the cathode (31/32) can close off the vacummized internal chamber (41/42) toward the outside.

18 Claims, 2 Drawing Sheets

Figure 1:
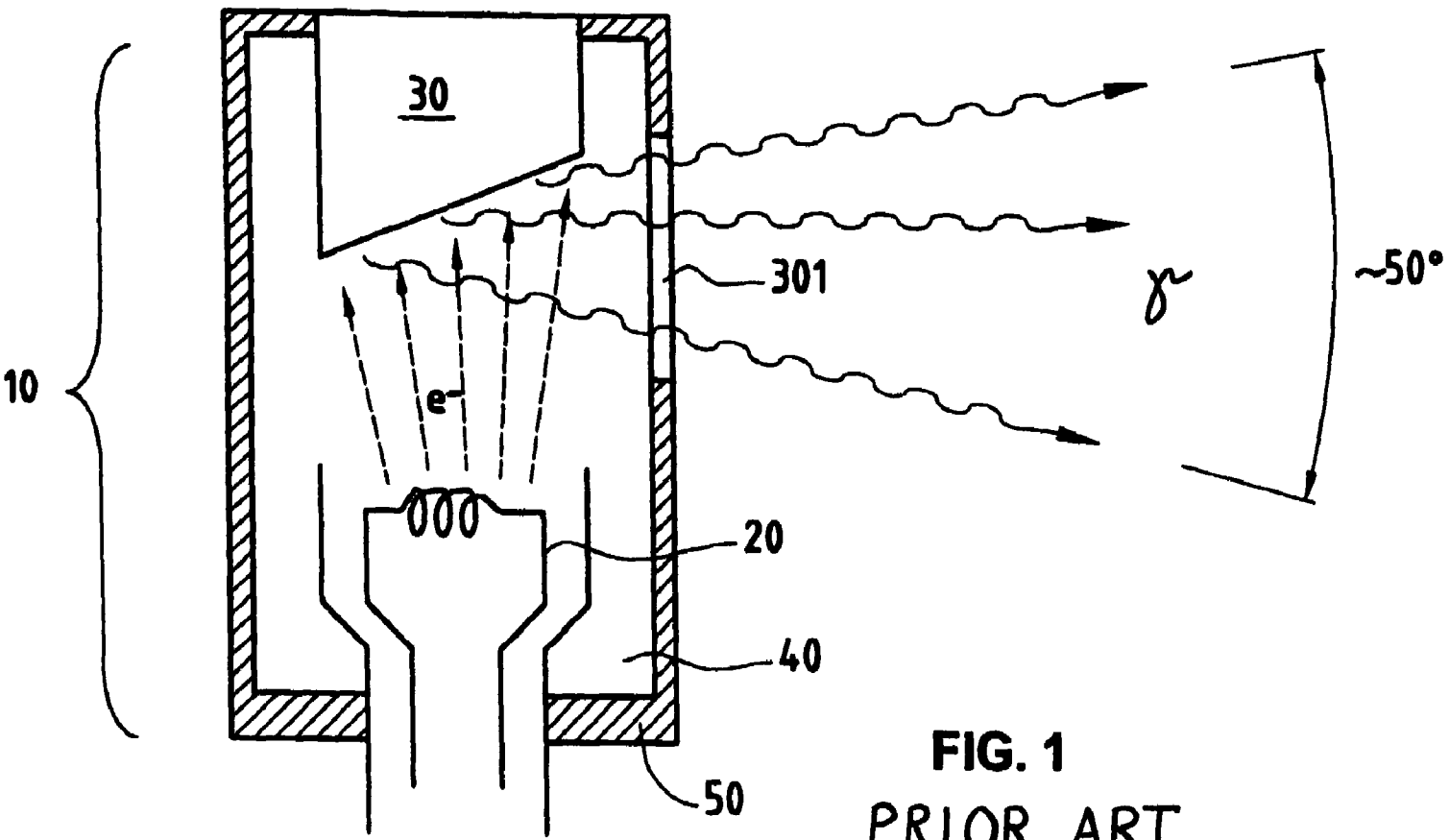
FIG. 1 PRIOR ART

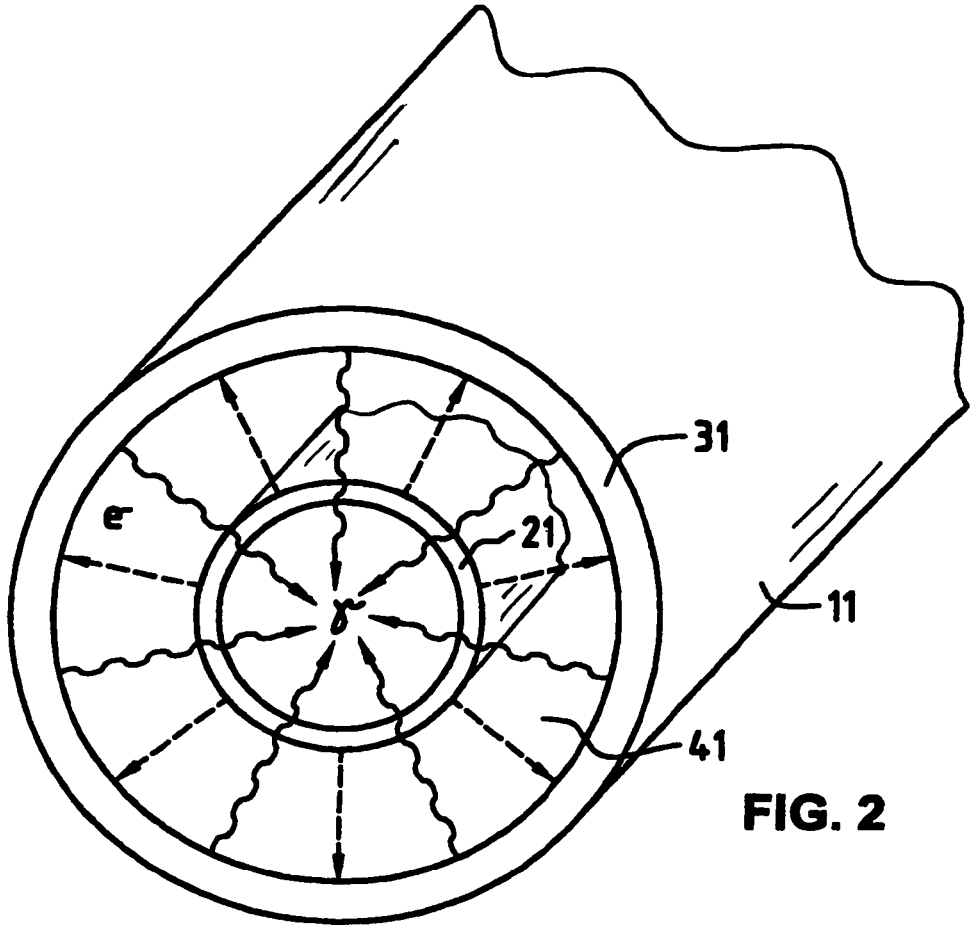
FIG. 2
FIG. 3
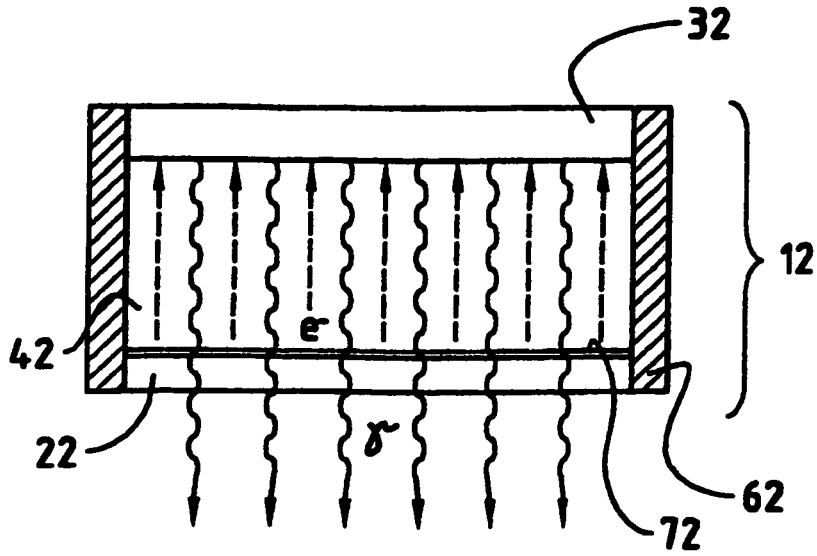

X-RAY TUBE FOR HIGH DOSE RATES, METHOD OF GENERATING HIGH DOSE RATES WITH X-RAY TUBES AND A METHOD OF PRODUCING CORRESPONDING X-RAY DEVICES

This invention relates to an X-ray tube for high dose rates, a corresponding method for generating high dose rates with X-ray tubes as well as a method of producing corresponding X-ray devices, in which an anode and a cathode are disposed situated opposite each other in a vacuumized inner space, electrons being accelerated to the anode by means of impressible high voltage.

Recently a lot of time and effort of industry and technology has been directed toward improving the efficiency of irradiation systems. Irradiation systems find application not only in medicine, e.g. in diagnostic systems or with therapeutic systems for irradiation of diseased tissue, but are also employed e.g. for sterilization of substances such as blood or foodstuffs, or for sterilization (making infertile) of creatures such as insects. Other areas of application are to be further found in classical X-ray technology such as e.g. x-raying pieces of luggage and/or transport containers, or non-destructive testing of workpieces, e.g. concrete reinforcements, etc. Thus diverse methods and devices have been developed for γ-ray systems or X-ray systems in order to obtain a higher percentage of usable X-rays from the gamma emitters. This means that a multitude of systems have been developed in the attempt to increase the percentage of energy converted into γ-rays, which can then really be used for irradiation. Also attempted in the same way through newly developed systems and methods has been to obtain a more uniform distribution of the γ-rays over the surfaces to be irradiated. With all systems and methods, in particular with those using e.g. $^{60}Co$ or $^{137}Cs$ as gamma emitters, great efforts have been made furthermore to obtain a more uniform irradiation over various depths of the irradiated material. In the state of the art, the absorbed energy distribution for a particular substance depends upon a multitude of parameters, in particular upon the material irradiated, the distance from the radiation source to the irradiated substance, and the geometry of the irradiation method.

X-ray tubes having the required capacities usually comprise in the state of the art an anode and a cathode which are disposed opposite each other in a vacuumized internal chamber and which are enclosed by a cylindrical metal part. Anode and/or cathode are thereby electrically insulated by means of an annular ceramic insulator, the ceramic insulator or insulators being disposed behind the anode and/or cathode, axially to the metal cylinder, and closing the vacuum chamber at the respective end. In the middle of their disk, the ceramic insulators have an opening in which a high voltage supply, the anode or the cathode are installed vacuum-tightly. This type of X-ray tube is also referred to as a bipolar X-ray tube in the state of the art.

A conventional X-ray emitter according to the state of the art is reproduced e.g. in FIG. 1. An electron beam is thereby generated from an electron emitter, as a rule a tungsten coil, and is accelerated to a target by means of an applied high voltage. Anode (target) and cathode are disposed opposite each other in a vacuumized internal chamber, and are normally enclosed by a cylindrical metal part. Anode and/or cathode are thereby electrically insulated by means of an annular ceramic insulator, the ceramic insulator or insulators being disposed behind the anode and/or cathode, axially to the metal cylinder, and closing the vacuum chamber at the respective end. With impingement of the electrons on the target, X-ray radiation (γ-radiation) is thereby generated at the thus arising focal spot. The X-ray radiation emerges into the outer space through a window, and is used for irradiation purposes. This type of X-ray tube is also termed bipolar X-ray tube in the state of the art. Despite the efforts mentioned above, the drawbacks of the state of the art could not be overcome or could only be overcome insufficiently. Thus, for example, only a small portion of the radiation generated at the target reaches the material to be irradiated. For reasons of geometry, the major part of the radiation is absorbed in the tube itself. Depending upon the size of the object, a particular irradiation spacing must be chosen in order to irradiate the object completely. Moreover the dose rate per surface element in such a configuration is determined by the distance of the object from the focal point of the tube and by the quantity of radiation that is generated at the focal point. This amount of radiation is limited, for its part, by the thermal energy which must be discharged through cooling of the focal point so that the material in the focal point does not melt. The focal point is, as a rule, thereby clearly smaller than the object to be irradiated, i.e. the radiant flux density to be used decreases from the focal point to the object at approximately the square of the distance. For reasons of cooling technology, the radiation capacity of such radiation emitters is limited to a few kW, typically about 6 kW. Because of these two factors the specific dose rate of such a configuration is greatly limited.

The U.S. patent application US 2002/0021068 discloses a device for generating electromagnetic radiation. The walling of the tube serves at the same time as cathode, and is transparent for the X-ray radiation. In an embodiment variant, the cathode possesses a thin electron-emitting layer. The X-rays emerging from the target pass through the cathode, and are radiated to the outside.

The U.S. patent application US 2001/0019601 describes a cold cathode, which consists of nano tubes.

In the miniaturized X-ray tube described in the patent document U.S. Pat. No. 5,729,583 the anode of the X-ray tube is designed at the same time as walling of the X-ray tube head. The X-ray radiation is emitted directly to the outside.

The cathode in the X-ray tube disclosed in the U.S. American patent application U.S. 2003/0002627 is a carbon nano tube, or possesses a layer of a similar substance.

The American patent U.S. Pat. No. 6,477,233 discloses a miniaturized X-ray tube in which the two electrodes are disposed opposite each other inside a cavity formed by the walling.

The German patent document DE 198 32 032 discloses an X-ray tube with a thermal cathode, which is nevertheless suitable for use in catheters for treatment of blood vessels. In this X-ray tube, the cathode is designed as a solid cylinder.

Thanks to its very minimal size, a miniaturized X-ray tube such as in the international patent application WO 99/62589 can be used to treat tissue inside the human body. One of the embodiment variants discloses an X-ray tube in which the anode is designed as hollow cylinder.

The French patent application FR 2 574 592 describes a back scatter X-ray tube by means of which X-ray radiation of very high power and very short duration can be generated. For this purpose the described X-ray tube possesses a focusing mechanism for the electrons accelerated to the target.

The patent applications US 2003/0063707, US 2004/0008818 as well as the patent document U.S. Pat. No. 4,670,894 disclose X-ray tubes having at least partially a cylindrical shape.

It is an object of this invention to propose a new X-ray tube for high dose rates and a corresponding method for generating high dose rates with X-ray tubes which do not have the drawbacks described above. In particular, an X-ray emitter should be proposed which enables a dose rate many times higher than conventional X-ray emitters. Likewise the percentage of usable energy converted into γ-rays should be increased, and a more uniform distribution of the γ-rays with respect to the surface to be irradiated and the depth of the material should be obtained.

This object is achieved according to the invention in particular through the elements of the independent claims. Further advantageous embodiments follow moreover from the dependent claims and from the description.

In particular, these object are achieved according to the invention in that in the X-ray tube an anode and a cathode are disposed opposite each other in a vacuumized internal chamber, electrons being able to be accelerated to the anode by means of impressible high voltage, the cathode comprising a thin layer or coating of an electron-emitting material, and the cathode comprising a substrate substantially transparent for X-ray radiation, the X-ray tube being designed as an anode hollow cylinder with a coaxial cathode hollow cylinder inside. This embodiment variant has the advantage, among others, that e.g. the material to be irradiated can be put inside the cathode hollow cylinder. This ensures an evenly high and homogeneous irradiation of the object from all sides (4π), which would hardly be possible otherwise. This embodiment variant can be suitable in particular for sterilization with continuous conveyance of the material to be sterilized, and thus for high throughput.

In another embodiment variant, the cathode can thereby close the vacuumized internal chamber toward the outside, for example. For conversion of the electrons into X-ray radiation, the anode can comprise in particular e.g. gold and/or molybdenum and/or tungsten and/or a compound of the metals. An advantage of the invention is, among others, that the cooling of the anode can be optimized since the anode does not have to be selected to be transparent for X-ray radiation, compared with a design alternative with an anode transparent for X rays.

In an embodiment variant, the cathode comprises a thermionic emitter. This embodiment variant has the advantage, among others, that thermionic emitters are state of the art in X-ray tubes, and distinguish themselves through high stability and long service life. The emitters can thereby be made from heated tungsten wires which are either strung parallel or are welded to a mesh grid. Emitters of barium hexaboride or so-called heated dispenser cathodes based on barium mixed oxides can also be used, however, which have a very high emission current density, and can be arranged in groups in order to achieve large-area cathodes.

In another embodiment variant, the cathode comprises a cold emitter, in particular with metal tips and/or carbon tips and/or carbon nano tubes. This embodiment variant has the advantage, among others, that the emitters can be installed in a thin layer on a substrate in a large-area way, and can thereby result in little to no heat loss in operation. A cooling can thereby be omitted, and a high transmission for X-rays can be ensured for the cathode. These cold emitters are preferably combined with an extraction grid with which the current density can be controlled.

In another embodiment variant, the cathode comprises a substrate for the thermionic emitters or the cold emitters of a material especially penetrable for X rays, such as e.g. beryllium, aluminum or in particular pyrolytic graphite. The substrate can thereby be designed such that it serves at the same time as the closure of the vacuum vessel.

It should be stated here that, besides the method according to the invention, this invention also relates to a device for carrying out this method as well as to a method for producing such a device.

Embodiment variants of the present invention will be described in the following with reference to examples. The examples of the embodiments are illustrated by the following enclosed figures:

FIG. 1 shows a block diagram illustrating schematically an X-ray tube 10 of the state of the art. Electrons $e^-$ are thereby emitted from a cathode 20, and X-rays γ radiated from an anode 30 through a window 301.

FIG. 2 shows a block diagram, illustrating schematically the architecture of one embodiment variant of an X-ray tube 11 according to the invention. Electrons $e^-$ are thereby emitted by a transmission cathode 21, and X rays γ radiated from an anode 31, the cathode 21 forming the cylinder barrel of a cylindrical tube core, and closing the vacuumized internal chamber 41.

FIG. 3 shows a block diagram, illustrating schematically the architecture of an embodiment variant of an X-ray tube 12 according to the invention. Electrons $e^-$ are thereby emitted from a transmission cathode 22, and X rays γ emitted from an anode 32, the cathode 32 closing the vacuumized internal chamber 42 toward the outside. The anode 32 is designed as a round or angular surface, and is irradiated by a transmission cathode 22 of laminar, reticulate, or linear form.

FIGS. 2/3 illustrate architectures as they can be used to achieve the invention. In these embodiment examples for an X-ray tube 11/12 with high dose rate, or respectively for a method for generating X rays with high dose rate, an anode 31/32 and a cathode 21/22 are disposed opposite each other in a vacuumized internal chamber 41/42. By means of impressible high voltage, electrons $e^-$ are accelerated to the anode 31/32 through the vacuumized internal chamber 41/42. In other words, the electrons are focused by the cathode 21/22 on a large surface of the anode 31/32 or on the entire anode 31/32, and generate X-ray radiation γ there. The vacuumized internal chamber 41/42 can be enclosed e.g. by a metal housing 52, for instance a cylindrical metal housing. The metal housing 52 can have e.g. a minimal wall thickness of 2 mm. It is likewise conceivable for the metal housing 50/52 facing the vacuumized internal chamber 41/42 to be electropolished and/or mechanically polished. The anode 31/32 and/or the cathode 21/22 can be electrically insulated by means of an annular and/or discoidal insulator 62. The insulator can e.g. be composed substantially of an insulating ceramic material. Conceivable as ceramic material is e.g. ceramic material of at least 95% $Al_2O_3$. Sintered on the ceramic can be a single or multiple layer of an alloy, for example. The alloy can comprise e.g. an MoMnNi alloy. Conceivable moreover is that the vacuumized internal chamber is enclosed by a ceramic housing, which at the same time insulates the cathode from the anode. The cathode 21/22 comprises a substrate substantially transparent for X-ray radiation γ. The cathode 21/22 can further comprise e.g. a thermionic cathode material (tungsten, tantalum, lanthanum hexaboride or barium mixed oxide) or a cold emitter. If the cathode 21/22 comprises a cold emitter, it can contain e.g. metal tips and/or graphite tips and/or carbon nano tubes. Through this configuration, the cathode 21/22 acts as the transmission cathode 21/22 for the γ-radiation. As mentioned, the substrate, such as e.g. Be (beryllium), Al (aluminum) or graphite, in particular pyrolytic graphite, is preferably as transparent as possible for X-ray radiation γ.

According to the invention, the vacuumized internal chamber 41/42 of the X-ray tube 11/12 can be closed off by the transmission cathode 21/22 from the outside, at an outer perimeter or respectively at an inner perimeter, for example. The radiation goes through the transmission cathode 21/22, and behind it hits the material to be irradiated. The anode 31/32 comprises a layer of a metal with a high atomic number, e.g. gold and/or molybdenum and/or tungsten and/or a compound of the metals, allowing an efficient conversion into X-ray radiation γ. The anode 31/32 further comprises a cooling for cooling the thermal energy being created. The anode 31/32 must be cooled since typically only about 1% of the electric capacity is converted into X-ray radiation, and the rest must be given off as heat. The cooling can take place using water or with forced air. Through the configuration according to the invention, the entire radiation can be made use of in the outer half space. In contrast, in the conventional configuration, only about 10% of the radiation can be used in the half space (with 50° angle of opening of the window). A second advantage is that the area irradiated by the electrons $e^-$ is considerably larger in the design according to the invention than in the conventional configuration. Assuming an irradiated area (anode) of 20×20 $cm^2$ and a possible cooling capacity in this area of 200 $W/cm^2$, there results a possible total electrical power of 80 kW, in contrast to 6 kW with the conventional tube. That is a further increase by a factor of 10. A transmission cathode 21/22 possibly absorbs, however, more radiation than the window in a conventional tube, depending upon the design. The output radiation can thereby be reduced by about half, depending upon wavelength. A dose rate increased overall by a factor of 50 still nevertheless results from this on a area of about 20×20 $cm^2$, compared with the configuration with a conventional X-ray emitter. This increase in dosing capacity makes it possible, for example, to carry out sterilization with X rays in very short time periods.

FIG. 1 shows schematically an architecture of such a conventional X-ray tube 10 of the state of the art. Electrons $e^-$ are thereby emitted from an electron emitter, i.e. a cathode 20, as a rule a hot tungsten coil, are accelerated to a target through impressed high voltage, X rays γ being emitted from the target, i.e. from the anode 30, through a window 301. In other words, with the impingement of the electrons $e^-$ on the target, X-ray radiation γ is generated at the thus arising focal spot. The X-ray radiation emerges into the outer space through a window 301, and is used for irradiation purposes. Of the radiation generated on the target, only a small portion reaches the material to be irradiated. For reasons of geometry, the major part of the radiation is absorbed in the tube itself. For this reason, in order to irradiate the object completely, a particular irradiation spacing must be selected, depending upon the size of the object. In conventional configurations, typically, only about 10% of the radiation can be used in the half space of the target surface. FIG. 1 shows an emission window 301 with an opening of 50°.

FIG. 2 shows schematically the architecture of one embodiment variant of an X-ray tube 11 according to the invention. Electrons $e^-$ are thereby emitted from a transmission cathode 21, and X rays γ are emitted from an anode 31, the cathode 21 forming the cylinder barrel of a cylindrical tube core, and closing the vacuumized internal chamber 41. In other words, the X-ray tube 11 is designed as anode hollow cylinder 31 with a coaxial cathode hollow cylinder 21 inside. Anode 31 and cathode 21 can be achieved as described in more detail further above, for example. The electrons $e^-$ are accelerated from the transmission cathode 21 to the anode 31, and generate there X-ray radiation γ. The X-ray radiation γ penetrates the cathode 21 transparent for X-ray radiation γ. A uniform and very high 4π-gamma radiation, for example, can thus be achieved inside the cathode hollow cylinder 21. The material to be irradiated can be placed inside the cathode hollow cylinder 21. This ensures an even irradiation of the object from all sides, which would hardly be possible otherwise. This can be especially expedient for sterilization. It can be said that this embodiment variant is particularly suitable for sterilization with continuous conveyance of the material to be sterilized, and thereby for high throughput. A further advantage of this embodiment example is that since the anode does not have to be selected to be transparent for X-ray radiation, the cooling of the anode can be optimized compared with an embodiment variant with an anode transparent for X rays.

FIG. 3 shows schematically an architecture of a section of an X-ray tube 12 according to the invention. Electrons $e^-$ are thereby emitted from thermionic or cold emitters 72 in a transmission cathode 22, and X rays y are radiated from an anode 32, the cathode 22 closing the vacuumized internal chamber 42 from the outside. The cathode 22 is designed as a round or angular surface, the anode 32 being irradiated by the emitters 72 of laminar, reticular or linear design, for example. Like reference numeral 50, reference numeral 52 designates e.g. a metallic cylindrical housing 52, which comprises the vacuumized internal chamber 42, and reference numeral 62 designates an insulator, which separates the potential of the cathode and of the anode. It is also conceivable, however, for the housing 52 to be produced out of an insulating material, and for the insulator 62 to then be omitted. It is to be pointed out that the embodiment variants described by means of FIGS. 2 and 3 are especially intended for use of cold emitters, through the use of large-surface electron emitter configurations. Configurations with thermal cathodes are of course also conceivable, however.

The invention claimed is:

1. An X-ray tube for high dose rates comprising:

an anode and a cathode being disposed opposite each other in a vacuumized internal chamber, electrons being able to be accelerated to the anode by impressible high voltage for producing X-ray radiation from said anode;

the cathode comprising a thin layer of an electron emitting material, and a substrate substantially transparent for X-ray radiation such that the entire cathode is substantially transparent to X-ray radiation;

the X-ray tube being constructed with said anode being a hollow cylinder and said cathode being a coaxial cathode hollow cylinder positioned inside said anode; and said anode constructed to emit X-ray radiation in a direction opposite to the direction of emitted electrons from said cathode back to and through said cathode to a target area situated within the confines of said cathode.

2. The X-ray tube according to claim 1, wherein the cathode closes the vacuumized internal chamber from the outside.

3. The X-ray tube according to claim 1, wherein the anode comprises gold and/or molybdenum and/or tungsten and/or a compound of the metals, for conversion of the electrons into X-ray radiation.

4. The X-ray tube according to claim 1, wherein the cathode comprises a thermionic emitter.

5. The X-ray tube according to claim 1, wherein the cathode comprises a cold emitter.

6. The X-ray tube according to claim 5, wherein the cold emitter comprises metal tips and/or graphite tips and/or carbon nano tubes.

7. An X-ray tube as defined in claim 1 further comprising:

said hollow cylinder of said cathode constructed to emit electron emissions 360° about said hollow cylinder;

said anode being constructed to emit X-rays back to said cathode about a 360° angle and through said cathode to a target area within the confines of said cathode.

8. An X-ray tube as defined in claim 7 further comprising: said anode being not transparent to said X-ray radiation.

9. An X-ray tube as defined in claim 1 further comprising: said anode being not transparent to said X-ray radiation.

10. A method for generating high dose rates with X-ray tubes, in which an anode and a cathode are disposed opposite each other in a vacuumized internal chamber, electrons being accelerated to the anode by impressible high voltage for producing X-ray radiation from said anode, a substrate substantially transparent for X-ray radiation (γ) being used in the cathode, and a thin layer or coating of an electron emitting material being applied to the substrate such that the cathode is substantially transparent to X-ray radiation, wherein;

said anode is an anode hollow cylinder with a coaxial cathode hollow cylinder inside to direct X-ray radiation back to and through said cathode to a target area within the confines of said cathode.

11. The method according to claim 10, wherein the cathode closes the vacuumized internal chamber from the outside.

12. The method according to claim 10, wherein gold and/or molybdenum and/or tungsten and/or a compound of the metals is used for conversion of the electrons into X-ray radiation.

13. The method according to claim 10, wherein a thermionic emitter is used in the cathode.

14. The method according to claim 10, wherein a cold emitter is used in the cathode.

15. The method according to claim 14, wherein metal tips and/or graphite tips and/or carbon nano tubes are used for the cold emitter.

16. A method for producing an X-ray tube for high dose rates, in which an anode and a cathode are disposed opposite each other in a vacuumized internal chamber, electrons being accelerated to the anode by impressible high voltage, a substrate substantially transparent for X-ray radiation being used in the cathode, and a thin layer or coating of an electron emitting material being applied to the substrate, wherein;

the X-ray tube is constructed as an anode hollow cylinder with a coaxial cathode hollow cylinder inside that is substantially transparent to X-ray radiation to allow X-ray radiation to pass therethrough to a target area within the confines of the cathode.

17. The method according to claim 16, wherein the cathode closes the vacuumized internal chamber from the outside.

18. An X-ray tube for high does rates of X-ray radiation comprising:

an anode and a cathode being disposed opposite each other in an vacuumized internal chamber, electrons being able to be accelerated to the anode by impressible high voltage to produce X-ray emissions from said anode;

the cathode comprising a substrate and a thin layer of an electron emitting material such that said cathode is substantially transparent to X-ray radiation, said cathode shaped to emit electron emissions over a wide angle; and said anode being similarly shaped as said cathode to emit X-rays back to and through said cathode and to a target area situated on the other side of said cathode from said anode over said wide angle.

* * * * *